United States Patent [19]

Golden et al.

[11] 4,154,462

[45] May 15, 1979

[54] TRANSFER SHEET COATED WITH MICROCAPSULES AND OIL-ABSORPTIVE PARTICLES

[75] Inventors: Ronald Golden, Mount Prospect; Anthony E. Vassiliades, Deerfield, both of Ill.

[73] Assignee: Champion International Corporation, Stamford, Conn.

[21] Appl. No.: 808,634

[22] Filed: Jun. 21, 1977

Related U.S. Application Data

[63] Continuation of Ser. No. 626,735, Oct. 30, 1975, abandoned.

[51] Int. Cl.[2] ..... B41L 1/36

[52] U.S. Cl. ..... 282/27.5; 427/152; 427/153; 428/306; 428/307; 428/323; 428/327; 428/328; 428/330; 428/331; 428/913; 428/914

[58] Field of Search ..... 428/323, 327, 913, 306, 428/307, 308, 328, 330, 331, 914; 427/152, 153; 282/27.5

[56] References Cited

U.S. PATENT DOCUMENTS

| | | | |
|---|---|---|---|
| 3,389,007 | 6/1968 | Oda | 428/323 |
| 3,844,816 | 10/1974 | Vassiliades | 282/27.5 |
| 3,900,671 | 8/1975 | Evans | 428/323 |
| 3,906,123 | 9/1975 | Vincent | 428/411 |
| 3,955,025 | 5/1976 | Matsukawa | 428/323 |

FOREIGN PATENT DOCUMENTS 1232347 5/1971 United Kingdom.

*Primary Examiner*—Ellis Robinson
*Attorney, Agent, or Firm*—Evelyn M. Sommer

[57] ABSTRACT

A transfer sheet is provided having a substrate coated with pressure-rupturable microcapsules containing an oil and an oil-soluble dye intermediate and a particulate oil-absorptive material which is non-reactive with the dye intermediate and is situated with respect to said microcapsules such that oil released by the microcapsules is absorbed thereby. The concentration of oil absorptive material is sufficient to permit writing on the coated substrate without interference from oil released by ruptured microcapsules but less than that which materially reduces the transfer of oily solution from ruptured microcapsules to an underlying copy sheet.

17 Claims, No Drawings

TRANSFER SHEET COATED WITH MICROCAPSULES AND OIL-ABSORPTIVE PARTICLES

This is a continuation of application Ser. No. 626,735, filed Oct. 30, 1975, now abandoned.

BACKGROUND OF THE INVENTION

This invention relates to a microencapsulation system, to a method for preparing the microencapsulation system and to pressure-sensitive transfer sheets employed in this system.

At the present time, microencapsulation systems including pressure-sensitive transfer sheets utilizing microcapsules containing an oily liquid and a colorless dye intermediate are well known in the art. In these systems, the sheet is formed of a suitable substrate such as paper having coated thereon microcapsules comprising a polymeric wall which surrounds an oil droplet containing the colorless dye intermediate. Generally, the microcapsules are coated on the substrate by utilizing a polymeric binder composition. In use, the coated surface of the transfer sheet is positioned against an underlying copy sheet and pressure is supplied to the uncoated surface of the transfer sheet to rupture the capsules and effect transfer of the dye intermediate to the underlying copy sheet. The copy sheet contains a composition which is reactive with the dye intermediate to form visible colored marks at that portion of the surface of the copy sheet adjacent to the capsules which have been ruptured and from which the dye intermediate has been transferred.

While this transfer system has proven to be satisfactory in applications wherein it is desired merely to form an image on the copy sheet corresponding to the image formed under pressure on the uncoated surface of the transfer sheet, less than satisfactory results have been obtained in other applications. For example, in a transfer system wherein it is desired not only to form the copy on the copy sheet but it is also desirable to permit the user to write on the coated surface of the transfer sheet with commonly employed oil-based inks such as are employed in ball-point pens, the written image obtained is often incomplete. This is because the pressure needed to effect the writing is sufficient to rupture the microcapsules thereby releasing oil which admixes with the applied ink and contaminates the printing press or the ball-point pen tip thereby interrupting the ink flow. Thus, attempts to write on the coated surface with a ball-point pen typically result in clogging and skipping, similar to the effect observed when trying to write on a greasy or oily surface.

Prior attempts to solve these problems including changing the nature of the polymeric composition used to form the microcapsules or applying a protective coating over the microcapsules have proven to be unsatisfactory in that they cause a material reduction in the transfer of oil and dye intermediate from ruptured capsules to the copy sheet under normally employed writing pressure. Accordingly, it would be desirable to provide a means which would permit printing or writing with oil-based inks on the coated surface of the transfer sheet without adverse effects on the transfer of the oil-based dye intermediate from ruptured microcapsules.

SUMMARY OF THE INVENTION

The present invention is based upon the discovery that an improved transfer sheet is obtained by coating a substrate with pressure-rupturable microcapsules containing an oil and an oil-soluble dye intermediate, and with particulate, oil-absorptive material which is nonreactive with the dye intermediate and is situated with respect to the microcapsules such that oil released from said microcapsule can be absorbed by said particulate material. The resulting composite surface permits writing thereon without interference from the oil and permits transfer of the dye intermediate to an underlying copy sheet under normally employed writing pressure on the uncoated sheet surface. The transfer sheet comprises (i) a substrate such as paper, (ii) a coating thereon comprising microcapsules each having a continuous polymeric wall encapsulating an oil and an oil-soluble dye intermediate and (iii) a particulate oil-absorptive material situated with respect to the microcapsules such that oil released from said microcapsules, either upon rupture or by diffusion, can be absorbed by said particulate material. The particulate oil-absorptive material is unreactive with the dye intermediate in that it does not form a colored image when contacted with the dye intermediate.

DESCRIPTION OF SPECIFIC EMBODIMENTS

The transfer sheet of this invention is particularly useful in applications wherein it is desired to maintain a master copy of paper originals and wherein it is desired to permit writing on both surfaces of the originals such as in bank check manifolds in which a copy of each bank check is retained on the master.

The particulate absorptive material can be applied to the microcapsules either by direct admixture therewith or by coating the absorptive material as a substantially separate layer over the layer containing the microcapsules. In any event, the particles are applied to the substrate in a manner such that they are retained thereon with a polymeric binder. If desired, the particles can be applied to the substrate either with the microcapsules or subsequent to applying the microcapsules to the substrate. In any event, the composition containing the particles must be compatible with the microcapsules so that the resultant composition either contains a binder for the particles or comprises a reaction system which will form a binder for the particles while not rupturing the microcapsules or weakening the walls of the microcapsules thereby preventing substantial migration of oil from unruptured microcapsules.

Useful coatings on the substrate which contain both the microcapsules and the particles can be obtained by employing any one of a number of conventional coating techniques. In a broad aspect of the process of this invention, the binder for the particles can be formed either by incorporating a water soluble polymeric material in admixture with the particles, incorporating a material with the particles which acts as a cross-linking agent for a polymeric component used to form the microcapsules or by a combination of these techniques. Depending upon the particular coating technique employed, the absorptive particles can be directly admixed with the microcapsules or they can be separated from the microcapsules by a polymeric barrier.

When forming an admixture of microcapsules and particles, the composition comprising the microcapsules and particles can contain a binder and/or a cross-linking agent for the polymer forming the microcapsule wall. This composition can be applied to a substrate in a one-step process. When it is desired to include a polymeric barrier, it can be formed either in a two-step coating process or in a three-step coating process. When employing the two-step coating process, the microcapsules are coated on the substrate in a first step. Thereafter, a composition comprising the absorptive particles and a polymeric binder with or without a cross-linking agent for the polymer forming the microcapsule wall is applied over the microcapsular coating. When employing a three-step coating process, the microcapsules are coated on the substrate in a first step. An aqueous solution of a polymeric composition is applied over the microcapsule coating to form the polymeric barrier. Thereafter, a composition containing the oil absorptive particles is coated over the polymeric barrier in a manner such that the barrier retains the particles.

Transfer sheets made by incorporating absorptive particles with the microcapsules but without a cross-linking agent, are effective in that they do not adversely affect writing with oil-based inks. Their use is somewhat limited, however, since in some cases, over a period of time, it has been found that oil migrates by diffusion from the interior of the microcapsules and is absorbed by the absorptive particles so that the exposed surface of the particles contains some oil. When this occurs, writing thereon with oil-based inks may be adversely affected. Such oil migration can be effectively reduced by employing the polymeric barrier described hereinabove. However, care must be taken to ensure that the barrier coating does not become too thick so that migration of the oil from ruptured microcapsules may be seriously reduced. A preferred embodiment of this invention comprises a coating process wherein a cross-linking agent for an uncross-linked polymer in the microcapsule walls is incorporated with the particles so that when the cross-linking agent comes in contact with the microcapsules, a thin barrier is formed between the microcapsules and the absorptive particles which materially reduces migration of the oil by diffusion through the microcapsule walls but does not adversely affect migration of oil when the microcapsules are ruptured under normal writing pressure.

Regardless of the coating process employed to form the transfer sheet, the microcapsules are formed prior to contact with the absorptive particles. The particular method by which the microcapsules are formed is not critical to the present invention. Accordingly, the microcapsules can be formed by any known technique including coacervation or by forming the microcapsules in an emulsion whereby an oily material is dispersed as microdroplets in an aqueous continuous phase. The aqueous phase and the oily material each contain a reactant which reacts at the oil-water interface to form a polymeric, mechanically-stable capsule wall. Representative suitable methods for forming microcapsules and for coating them on a substrate such as paper are disclosed in U.S. Pat. No. 3,779,941 issued on Dec. 18, 1973, and U.S. Pat. No. 3,875,074 issued on Apr. 1, 1975, both of which are incorporated herein by reference.

In a preferred embodiment of this invention, the microcapsules are formed so that the walls thereof include a polymeric material which can be cross-linked by means of a cross-linking agent provided by the absorptive particle composition. These polymeric materials also can be partially cross-linked during the formation of the microcapsules. Representative suitable polymeric materials which can be subsequently completely cross-linked include the hydroxyl-containing polymers such as polyvinyl alcohol, methylcellulose, starch, carboxymethyl cellulose and the like; amino-containing materials such as proteins and mixtures of hydroxy- and/or amino-containing materials or the like. Polyvinyl alcohol is the preferred polymeric material for forming the microcapsules particularly those grades known as 88% (nominal) hydrolyzed high molecular weight products (e.g. commercially available as Covol 97-40 from Corn Products International (CPI) or Elvanol 50-42 from E. I. Dupont de Nemours & Co.). However, any of the available water-soluble grades either fully or partially hydrolyzed, whether of high or low molecular weight, can be utilized.

Substituted starches are the preferred form of starch for use in the present invention and can be provided by any suitable process. For example, they may be provided by an etherification of the starch in granular form under non-gelatinizing conditions with monofunctional etherifying agent which provides the starch with ether-linked hydrophobic groups. Thus, the starch granule will become more oleophilic due to the presence of a high percentage of hydrophobic groups. Thus, the term "substituted starch" as employed herein refers to a starch that has been rendered more oleophilic due to an increase in hydrophobic groups.

The etherification reaction is conducted until the starch becomes more hydrophobic and essentially non-gelatinizable. Finally, the starch is fragmented and reduced to submicron sized particles by treatment with steam under pressure. The starch is not swollen or cooked but is reduced to very fine particles which are mainly in the microscopic or colloidal size range. Such starches are described, for example, in U.S. Pat. No. 3,462,283 to Hjermstad et al., the disclosure of which is incorporated herein by reference.

When forming the microcapsules, the polymeric component can be partially cross-linked with an oil-soluble cross-linking agent dissolved in the oil microdroplets. Subsequently, cross-linking can be completed with a cross-linking agent which is added with the absorptive particles in an aqueous medium. Representative suitable cross-linking agents include sodium borate (borax), formaldehyde, glyoxal, formaldehyde condensation products, e.g. urea formaldehyde, melamine formaldehyde, or the like.

As described above, one alternative process for forming the transfer sheet of this invention involves overcoating the microcapsular layer with a cross-linkable polymer composition such as the hydroxy-containing polymers set forth above to form the polymeric barrier. This overcoating is quite thin so as to minimize its effect on oil transfer from ruptured microcapsules to the copy sheet. Generally, it is applied to the substrate in an amount of between about 0.05, and about 1.0 pounds per ream, (3300 sq. ft.) preferably between about 0.1 and about 0.5 pounds per ream. The polymer generally is applied as a dilute aqueous solution of about 0.5 to 10 wt. percent, preferably from about 1 to 3 wt. percent. Advantageously, a wetting agent can be included in the aqueous solution to insure complete wetting of the capsule coating thereby insuring continuity of the polymeric barrier formed therefrom. The wetting agent comprises between about 0.005 and 0.1 wt. percent preferably between about 0.01 and 0.03 wt. percent based upon the total weight of the aqueous polymer solution. Representative suitable wetting agents include anionic compounds, such as fatty acid salts, salts of higher alcohol sulfates, alkylbenzene sulfonates, alkylnaphthalene sulfonates, or salts of poly(oxyethylene) sulfates; nonionic compounds, such as polypropylene oxide-polyethylene oxide block copolymers, poly(oxyethylene) alkyl ethers, poly oxyethylene alkylphenol ethers, sorbitol fatty acid esters, poly(oxyethylene) sorbitol fatty acid esters, poly(oxyethylene) alkyl esters or fatty acid monoglycerides; and cationic compounds, such as, quaternary ammonium salts with long chain alkyl group(s) or pyridinium salts. Preferred surfactants are sodium lauryl sulfate or polypropylene oxide-polyethylene oxide block copolymers or the like. The preferred polymers useful for forming the polymeric barrier are the fully hydrolyzed medium or high molecular weight polyvinyl alcohols such as Elvanol 72-60 (available from E. I. du Pont de Nemours), Covol 9870 (CPI) or Vinol 125 (available from Air Products Corp.). However, any fully or partially hydrolyzed polyvinyl alcohol is satisfactory for this purpose. Other barrier materials can be used to form the polymeric barrier layer in this invention including other water-soluble polymers such as starch, modified starch, proteins, natural or artificial gums or any polymer capable of being made subsequently water insoluble by chemical reaction. The water solubility of the polymeric barrier coating should be eliminated before or during application of the particle coat. This can be achieved by adding a cross-linking agent such as glyoxal or a low molecular weight, water soluble urea formaldehyde or melamine formaldehyde resin to the aqueous polymer solution. Alternatively, a material such as borax which almost instantly insolubilizes or cross-links the barrier polymer can be added with the particles. The borax instantaneously forms a gel with polyvinyl alcohol, and this preserves the integrity of the barrier until the coating composition containing the particles has dried. The polymeric barrier coating also can comprise a solution of a material or materials which form a continuous, water insoluble film upon dehydration. Representative suitable materials include low molecular weight, water-soluble urea formaldehyde, or melamine formaldehyde resins which form highly cross-linked polymeric matrices upon dehydration.

The polymeric barrier coating also can comprise a solution of poly-functional material capable of cross-linking at least one of the materials making up the capsule walls and/or the capsule coating binder. Examples of such cross-linking agents are formaldehyde, glyoxal, borax, glutaraldehyde and the urea formaldehyde or melamine formaldehyde resins described above. After applying this overcoating, a separate coating of the absorptive particles and a cross-linking agent can be applied. When this latter coating contacts the surface of the microcapsules, cross-linking thereof is initiated so that a cross-linked polymeric barrier is formed between the absorptive particles and the microcapsules thereby minimizing or preventing migration of oil by diffusion from the unruptured microcapsules to the absorptive particles.

While the present invention has been described above with reference to the use of a cross-linking agent which cross-links a polymeric material either incorporated with the microcapsules or provided as a separate layer, it is to be understood that suitable binders for the absorptive particles can be employed which can form an effective barrier to oil migrating by diffusion from the microcapsules without a cross-linking agent. Thus, any water-soluble or water dispersible polymer which functions as a stable binder upon drying can be employed in the present invention. The binder can be added to the coating either with the microcapsule-forming layer or with the absorptive particles. In any event, the concentration of binder is such as to substantially reduce contact of the absorptive particles with oil that may migrate by diffusion from unruptured microcapsules but in a concentration less than that which substantially reduces migration of oil and dye intermediate from ruptured microcapsules from the transfer sheet to the copy sheet during use under normal writing pressures. Representative suitable binders which need not be cross-linked include polyvinyl chloride, vinyl chloride-vinylidene chloride copolymer, polyvinylidene chloride, nitrile rubber polymer latices or the like.

The absorptive particles useful in the present invention are those which are unreactive with the dye intermediates employed in the oil phase of the microcapsules. Representative suitable absorptive particles include paper coating clays such as kaolin, bleached kaolins, or pigments such as calcium carbonate, barium sulfate, talc, silica, calcium sulfate, titanium dioxide, mixtures thereof and the like. These absorptive particles normally have a size between about 0.1 and about 5 microns, preferably between about 0.25 and about 2 microns.

The oily materials used to form the oily nucleus of the microcapsules are those conventionally employed in the prior art and are water-immiscible and unreactive with respect to the dye-forming system employed. In the art of making a transfer sheet record material, a low viscosity-low vapor pressure oil is preferred. The viscosity of the oily medium is a determining factor in the speed with which the markings can be transferred to the copy sheet since low viscosity oils will transfer more quickly than oils of higher viscosity. The vapor pressure should be sufficiently low to avoid substantial losses of oil through evaporation during the encapsulation process. Suitable oily materials which may be employed include the aliphatic and aromatic hydrocarbon oils, such as kerosene, mineral spirits, naphtha, xylene, toluene, substituted biphenyls, terphenyls, napthalenes, diphenylmethanes and the like; terpenes, such as turpentine; esters, such as dimethyl phthalate, dioctyl phthalate, dimethyl azelate, methyls, 2-ethyl hexanoate, 2-ethylhexyl acetate or the like.

The amount of polymeric material used to form the microcapsule walls relative to the oily nucleus material employed will vary over a wide range depending upon the particular system under consideration. However, suitable amounts include between about 5 and 100 parts of polymeric material per 100 parts by weight oil, preferably between about 10 and about 50 parts of polymeric material per 100 parts by weight oil.

In forming the transfer sheet record material, known processes can be used to encapsulate an oily printing ink, such as may be used in smudge-proof typewriter ribbons or carbon papers. In such a use, it has been found expedient to encapsulate a colorless, water-insoluble dye intermediate dissolved in the oil. Colorless dye intermediates are wholly conventional in such utilities and are well known in the art. Exemplary of the colorless dye intermediates which have been contemplated for use in this invention are leuco dyes, such as crystal violet lactone and derivatives of bis(p-dialkylaminoaryl) methane such as disclosed in U.S. Pat. Nos. 2,981,733 and 2,981,738 which are incorporated herein by reference. These dye intermediates are colorless in an alkaline or neutral medium and react to form a visible color in an acidic medium. Thus, when a capsule containing such a compound is ruptured and the compound is discharged onto an absorbent, acidic electron-acceptor material, such as a paper web coated with an organic or an inorganic acid material, a visible color appears on the absorbent material at the point of contact.

Optionally, inhibitors can be dispersed in the oily material with the dye intermediates. Such materials are helpful in preventing the light and heat degradation of the intermediates during the encapsulation procedure, especially when elevated temperatures are required, such as when a fat is encapsulated. Inhibitors are also considered to aid in the stabilization of the colored marking on the copy sheet against the effects of the atmosphere. A small amount (generally about 1 to 10 percent by weight of the dye) of an inhibitor, such as N-phenyl-2-naphthylamine, can be used.

The leuco dye intermediates which are mentioned above are, in general, oil soluble. Oils which are inert with respect to the dye and in which the dye has appreciable solubility, e.g. above 0.5 grams of dye per 100 grams of oil, are preferable.

Microcapsules having diameters ranging from 0.1 to several hundred microns can be employed with capsules having diameters in the range of 3.0 to 5.0 microns being preferred.

The emulsion containing the microcapsules can be either coated directly onto a web material and dried or the microcapsules can be separated from the emulsion by some physical means such as filtration or centrifugation; washed, if desired; redispersed in a solution of a binder; coated onto a web material and dried. Suitable binders include methyl cellulose, starch, casein, polyvinyl alcohol, polyvinyl acetate latex, and styrene butadiene latex. Alternatively, materials such as urea-formaldehyde or melamine-formaldehyde condensates can be employed. The coating operation is performed by conventional means, such as by use of an air knife. The capsule coatings are dried at temperatures ranging from about 40° C. to 75° C. At these temperatures, no appreciable degradation of the capsules, and in particular, the leuco dye intermediate, takes place.

The web material commonly used in transfer sheet record material is paper and is, therefore, preferable in the practice of this invention. However, the microcapsules also are capable of being coated onto other materials such as plastic and fabric or textile webs. When using a web material having a high degree of porosity, it is advisable to pre-coat the web with a material which will reduce seepage of the microcapusle-containing coating through the web. Impregnating the web material with polyvinyl alcohol or a butadiene-styrene latex is the conventional practice for producing an essentially impervious substrate.

The following examples illustrate the present invention and are not intended to limit the same. Unless otherwise stated, all percentages and parts are by weight.

EXAMPLE I

This example illustrates the one-step coating process for making the transfer sheet of this invention wherein a binder and a cross-linking agent are incorporated into the coating composition.

250 Grams of a 6 percent aqueous solution of a medium molecular weight, 88 percent hydrolyzed poly (vinyl alcohol) (Dupont Elvanol 50-42) were used to emulsify an oily solution comprising 2.1 grams crystal violet lactone, 1.8 grams of benzoyl leuco methylene blue, eight grams of a polyfunctional isocyanate comprising an adduct of tolylene diisocyanate with trimethylolpropane, (Mobay CB-75), four grams of diethyl phthalate and 90 grams of an alkylated aromatic oil. Emulsification was effected by subjecting the mixture to high shear mixing at 25° C. for 1 minute. The resulting emulsion was diluted with 116 grams of water and cured at 60° C. for two hours, after which time suspended microcapsules were formed. The microcapsules ranged in size between 1 and 7 microns, with an average of about 4 to 5 microns.

80 Grams of these microcapsules, still suspended in water, were mixed with 30 grams of kaolin clay, 20 grams of water, 1.6 grams of a wet strength resin (Virginia Chemicals Virset 656-4) and 2.1 grams of 60 percent aqueous glyoxal for 5 minutes at about 25° C. The resultant composition was coated on a paper substrate at a coat weight of six to eight pounds per ream (3300 square feet). The resulting carbonless transfer paper sheet gave an image intensity of 69.6 on an underlying copy sheet, based on an arbitrary intensity scale. After heating the transfer sheet for three hours at 100° C., the image intensity produced under the same conditions still had a value of 54.1, indicating retention of most of its activity. The intensity scale is a logarithmic absorptivity scale read from the transfer image using a microdensitometer. The paper continued to produce strong images even after several months.

Attempts to write with a ball-point pen on the microcapsule-coated side of a transfer sheet made with capsules similar to those described above but without the clay were generally unsatisfactory. Considerable skipping and interruption of the ink line were observed in almost every case. In some cases, the pen stopped writing completely and had to be cleaned by writing on uncoated paper before the ink flow would resume. Fine point ball-point pens were particularly susceptible to this type of contamination. In contrast, the ball-point pen writability of the clay-capsule coated paper made by the above-described procedure was excellent. The ball-point pen produced an unbroken ink line and continued to write, even when considerable pressure was used.

EXAMPLE II

This example further illustrates the one-step coating process for making the transfer sheet of this invention wherein a binder and a cross-linking agent are incorporated in the coating composition.

250 Grams of a 6 percent aqueous solution of a medium molecular weight, 88 percent hydrolyzed poly (vinyl alcohol) (Dupont Elvanol 50-42) were used to emulsify an oily solution comprising 2.1 grams crystal violet lactone 1.8 grams of benzoyl leuco methylene blue, eight grams of a polyfunctional isocyanate (Mobay CB-75), four grams of diethyl phthalate and 90 grams of an alkylated aromatic oil. Emulsification was effected by subjecting the mixture to high-shear mixing at 25° C. for 1 minute. The resulting emulsion was diluted with 116 grams of water and cured at 60° C. for two hours, after which time suspended microcapsules were formed. The microcapsules ranged in size between 1 and 7 microns, with an average size of 4–5 microns.

40 Grams of these microcapsules, still suspended in water, were mixed with 15 grams of a paper coating grade calcium carbonate, 7.5 grams of water, 0.6 grams of a wet strength resin (Cyanamide Parez 613) and 2.1 grams of 50 percent aqueous glutaraldehyde for 5 minutes at about 25° C. The resultant composition was coated on a paper substrate at a coat weight of six to eight pounds per ream (3300 square feet). The resulting carbonless transfer paper sheet gave an image intensity of 65–70 on an underlying copy sheet, based on an arbitrary intensity scale. After heating the transfer sheet for three hours at 100° C., the image intensity produced under the same conditions still had a value of 55–60, indicating retention of most of its activity. The intensity scale is as defined in Example I. The paper continued to produce strong images even after several months.

Attempts to write with a ball-point pen on the microcapsule-coated side of a transfer sheet made with capsules similar to those described above but without the calcium carbonate were generally unsatisfactory. Considerable skipping and interruption of the ink line were observed in almost every case. In some cases, the pen stopped writing completely and had to be cleaned by writing on uncoated paper before the ink flow would resume. Fine point ball-point pens were particularly susceptible to this type of contamination. In contrast, the ball-point pen writability of the calcium carbonate-capsule coated paper made by the above-described procedure was excellent. The ball-point pen produced an unbroken ink line and continued to write, even when considerable pressure was used.

EXAMPLE III

This example still further illustrates the one step coating process for making the transfer sheet of this invention wherein a binder and a cross-linking agent are incorporated in the coating composition and wherein the microcapsules are formed by coacervation.

The microcapsules are prepared by the coacervation process used to form microcapsules containing an oily solution of crystal violet lactone from a gelatin-gum arabic emulsion as follows:

At 50° C. a solution of twenty grams of gum arabic dissolved in 160 grams of water is used to emulsify a solution of 2.1 grams of crystal violet lactone and 1.8 grams of benzoyl leuco methylene blue in 80 grams of alkylated naphthalene oil by shearing in a Waring blender. The emulsion is mixed with a solution of 20 grams of gelatin (isoelectric point pH8) in 160 grams of water at 50° C. The pH is adjusted to 8 with 10 percent sodium hydroxide and the emulsion is diluted with 500 grams of water at 50° C. after which the pH is slowly adjusted back to pH 4.5 with 10 percent acetic acid. The mixture is kept continuously agitated throughout all of these operations. 5 grams of 37 percent aqueous formaldehyde then are added, and the mixture then is cooled to 10° C., with agitation over a one-half hour period. The pH finally is adjusted to 9 with 10 percent sodium hydroxide.

80 Grams of these microcapsules are mixed with 25 grams of kaolin clay, 200 grams of 5 percent poly(vinyl alcohol) (Dupont Elvanol 50-42) and 3 grams of 50 percent aqueous glyoxal for 5 minutes at about 25° C. The resultant composition is coated on a paper substrate at a coat weight of 4 to 5 pounds per ream (3300 square feet). The resulting carbonless transfer paper sheet gives an image intensity of 65–70 on an underlying copy sheet, based on the arbitrary intensity scale of Example I.

Attempts to write with a ball-point pen on the microcapsule coated side of a transfer sheet made with complex coacervate capsules similar to those described above but without the clay were generally unsatisfactory. Considerable skipping and interruption of the ink line were observed in almost every case. In some cases, the pen stopped writing completely and had to be cleaned by writing on uncoated paper before the ink flow would resume. In contrast, the ball-point pen writability of the clay-capsule coated paper made by the above-described procedure was excellent. The ball-point pen produced an unbroken ink line and continued to write, even when considerable pressure was used.

EXAMPLE IV

This example illustrates the two-step coating process for making the transfer sheet of this invention wherein a binder without a cross-linking agent is incorporated in the coating composition.

250 Pounds of a 6 percent aqueous solution of a medium molecular weight, 88 percent hydrolyzed poly(vinyl alcohol) (Dupont Elvanol 50-42) were used to emulsify an oily solution comprising 2.1 pounds crystal violet lactone, 1.8 pounds of benzoyl leuco methylene blue, 8 pounds of a polyfunctional isocyanate (Mobay CB-75), 4 pounds of diethyl phthalate and 90 pounds of an alkylated aromatic oil. Emulsification was effected by subjecting the mixture to high-shear mixing at 25° C. for 1 minute. The resulting emulsion was diluted with 116 pounds of water and cured at 60° C., for 2 hours after which time, suspended microcapsules were formed. The microcapsules ranged in size between 1 and 7 microns, with an average of about 5 microns, 4.9 pounds of the microcapsules per ream (3300 square feet) were coated on a 33 pound per ream paper substrate.

A clay composition was prepared by mixing 100 pounds kaolin paper coating clay and 200 pounds of a 7 percent solution of poly(vinyl alcohol) Airco Vinol 125. The resultant composition was overcoated upon the microcapsule coated paper coated at a coat weight of 2.1 pounds per ream (3300 square feet). The resulting clay-coated transfer paper sheet gave an image intensity of 43.7 on an underlying copy sheet, based on the arbitrary intensity scale set forth in Example I.

Attempts to write with a ball-point pen on the microcapsule-coated side of a transfer sheet made as described above but without the clay, were generally unsatisfactory. Considerable skipping and interruption of the ink line were observed in almost every case. In some cases, the pen stopped writing completely and had to be cleaned by writing on uncoated paper before the ink flow would resume. Fine ball-point pens were particularly susceptible to this type of contamination. In contrast, the ball-point pen writability of the clay-capsule coated paper was excellent. The ball-point pen produced an unbroken ink line and continued to write, even when considerable pressure was used.

After heating the clay-coated sheet for 3 hours at 100° C., the image intensity was below 10 due to oil slowly leaching through the capsule walls. The same result was obtained after the clay-coated paper was allowed to stand for several weeks at normal room temperature.

EXAMPLE V

This example further illustrates the two-step coating process for making the transfer sheet of this invention wherein a binder and a cross-linking agent are incorporated in the coating composition.

250 Pounds of a 6 percent aqueous solution of a medium molecular weight, 88 percent hydrolyzed poly(vinyl alcohol) (Dupont Elvanol 50-42) were used to emulsify an oily solution comprising 2.1 pounds crystal violet lactone, 1.8 pounds of benzoyl leuco methylene blue, 8 pounds of a polyfunctional isocyanate (Mobay CB-75), 4 pounds of diethyl phthalate and 90 pounds of an alkylated aromatic oil. Emulsification was effected by subjecting the mixture to high shear mixing at 25° C. for 1 minute. The resulting emulsion was diluted with 116 pounds of water and cured at 60° C. for 2 hours, after which time suspended microcapsules were formed. The microcapsules ranged in size between 1 and 7 microns, averaging about 5 microns, 4.5 pounds of the microcapsules per ream (3300 square feet) were coated on a 33 pound per ream paper substrate.

A clay composition was prepared by mixing 100 pounds kaolin paper coating clay and 32 pounds of a 50 percent solids styrene-butadiene latex binder (Dow 620 latex) and 10 pounds borax with 150 pounds water for 1 hour at about 25° C. The resultant composition was overcoated on the microcapsule coated substitute at a coat weight of 2.1 pounds per ream (3300 square feet). The borax in the clay coating reacts substantially instantaneously with the poly(vinyl alcohol) forming the microcapsule walls to form a continuous, substantially impermeable barrier layer which isolates the capsules from the clay particles. The resulting clay-coated transfer paper sheet gave an image intensity of 63 on an underlying copy sheet, based on the arbitrary intensity scale set forth in Example I. After heating the clay-coated sheet for 3 hours at 100° C., the image intensity was 48, which is suitable for use in a typical carbonless copy paper manifold. The clay-coated paper still produced a strong image after one year at normal room temperature.

EXAMPLE VI

This example still further illustrates the two-step coating process for making the transfer sheet of this invention wherein a binder and a cross-linking agent are incorporated in the coating composition.

250 Pounds of a 6 percent aqueous solution of a medium molecular weight, 88 percent hydrolyzed poly(vinyl alcohol) (Dupont Elvanol 50-42) were used to emulsify an oily solution comprising 2.1 pounds crystal violet lactone, 1.8 pounds of benzoyl leuco methylene blue, 8 pounds of a polyfunctional isocyanate (Mobay CB-75), 4 pounds of diethyl phthalate and 90 pounds of an alkylated aromatic oil. Emulsification was effected by subjecting the mixture to high shear mixing at 25° C. for 1 minute. The resulting emulsion was diluted with 116 pounds of water and cured at 60° C. for 2 hours, after which time suspended microcapsules were formed. The microcapsules ranged in size between 1 and 7 microns, averaging about 5. 4.5 pounds of the microcapsules per ream (3300 square feet) were coated on a 33 pound per ream paper substrate.

A composition was prepared by mixing 100 pounds of a paper coating grade of calcium carbonate and 20 (dry) pounds of a vinyl chloride latex binder (Geon 577 Goodrich) (50 percent solids) and 10 pounds borax with 150 pounds water for 1 hour at about 25° C. The resultant composition was overcoated on the microcapsule-coated paper at a coat weight of 1–3 pounds per ream (3300 square feet). The resultant coated transfer paper sheet gave an image intensity of 50–60 on an underlying copy sheet, based on the arbitrary intensity scale set forth in Example I. After heating the calcium carbonate-coated sheet for 3 hours at 100° C., the image intensity was 40–50 which is suitable for use in a typical carbonless copy paper manifold. The clay-coated paper still produced a strong image after one year at normal room temperature.

EXAMPLE VII

A batch of the microcapsules described in Example IV is coated onto a paper substrate using a Dixon coater to provide a coat weight of 5.5 pounds per ream. Next, a second coating comprising 1 pound of a fully hydrolyzed, medium molecular weight polyvinyl alcohol (commercially available as Vinol 125 from Airco) in 99 pounds of water and 30 grams of a 30 percent by weight solution of aqueous sodium lauryl sulfate is coated over the capsule layer at a coat weight of 0.1 pound per ream. Next, a third coating comprising a clay slurry having a composition of the clay slurry described in Example V, including the 10 parts of sodium borate is applied over the barrier coat at a coat weight of 2 pounds per ream. All three of the coatings are applied with an air doctor.

The borax in the clay coating reacts substantially instantaneously with the poly(vinyl alcohol) of the intermediate barrier layer to form a continuous, substantially impermeable barrier layer which isolates the capsules from the clay particles. The resulting clay-coated transfer sheet gives an image intensity of 55 to 65 on an underlying receptor copy sheet. After heating for 3 hours at 100° C. the image intensity is still 45 to 55.

The ball-point pen writability of the clay-capsule coated paper was excellent.

What is claimed is:

1. A transfer sheet coated on one surface thereof with microcapsules containing at least one colorless dye intermediate and which permits marking on said coated surface thereof with oil-based inks comprising:
   (a) a substrate;
   (b) a coating comprising microcapsules containing an oil and an oil-soluble dye intermediate upon said substrate;
   (c) particulate oil absorptive material which is non-reactive with the dye intermediate and is situated with respect to the microcapsules such that oil released from said microcapsules can be absorbed by said particulate material; and
   (d) a substantially oil impermeable barrier interposed between the microcapsules and the particulate material; said barrier having a thickness sufficient to reduce migration of the oil released by diffusion through the microcapsule walls without substantially affecting migration of the dye intermediate released from ruptured microcapsules.

2. The article of claim 1 wherein the coating comprises an admixture of said microcapsules and said particulate absorptive material.

3. The article of claim 1 wherein the particulate absorptive material is overcoated upon the coating containing said microcapsules.

4. The article of claim 3 wherein the particulate absorptive material in a binder compatible with the microcapsules is overcoated upon the coating containing said microcapsules.

5. The article of claim 1 wherein the oil impermeable barrier is formed by coating a film-forming polymer, optionally containing a cross-linking agent, onto the microcapsules.

6. The article of claim 1 wherein the oil impermeable barrier is formed by reacting a cross-linkable polymer incorporated in the microcapsules with a cross-linking agent incorporated with the particular absorptive materal.

7. The article of claim 1 wherein the impermeable barrier comprises poly(vinyl alcohol).

8. The article of claim 1 wherein the barrier comprises the reaction product of poly(vinyl alcohol) and borax.

9. An article of manufacture comprising:

(A) a transfer sheet coated on one surface thereof with microcapsules containing at least one colorless dye intermediate and which permits marking on said coated surface thereof with oil-based inks comprising:

(a) a substrate;

(b) a coating comprising microcapsules containing an oil and an oil-soluble dye intermediate upon said substrate;

(c) particulate oil absorptive material which is nonreactive with the dye intermediate and is situated with respect to the microcapsules such that oil released from said microcapsules can be absorbed by said particulate material; and (d) a substantially oil impermeable barrier interposed between the microcapsules and the particulate material; said barrier having a thickness sufficient to reduce migration of the oil released by diffusion through the microcapsule walls without substantially affecting migration of the dye intermediate released from ruptured microcapsules; and (B) a copy sheet underlying said transfer sheet adjacent said one surface, and containing a composition reactive with the dye intermediate upon contact therewith to form a visible reaction product.

10. The article of claim 9 wherein the concentration of particulate absorptive material on the transfer sheet is sufficient to permit writing on said one surface thereof without interference from oil released by ruptured microcapsules but less than that which materially reduces the transfer of the dye intermediate from ruptured microcapsules to the copy sheet.

11. The article of claim 9 wherein the coating comprises an admixture of said microcapsules and said particulate absorptive material.

12. The article of claim 9 wherein the particulate absorptive material is overcoated upon the coating containing said microcapsules.

13. The article of claim 9 wherein the particulate absorptive material in a binder compatible with the microcapsules is overcoated upon the coating containing said microcapsules.

14. The article of claim 9 wherein the oil impermeable barrier is formed by coating a film-forming polymer, optionally containing a cross-linking agent, onto the microcapsules.

15. The article of claim 9 wherein the oil impermeable barrier is formed by reacting a cross-linkable polymer incorporated in the microcapsules with a cross-linking agent incorporated with the particulate absorptive material.

16. The article of claim 9 wherein the impermeable barrier comprises poly(vinyl alcohol).

17. The article of claim 9 wherein the barrier comprises the reaction product of poly(vinyl alcohol) and borax.

* * * * *